US005390368A

United States Patent [19]

Chang

[11] Patent Number: 5,390,368

[45] Date of Patent: Feb. 21, 1995

[54] REPLACEABLE SHOULDER PADDING FOR FOOTBALL PLAYERS

[76] Inventor: Chih P. Chang, No. 4, Lane 277, Fu Teh 1st Rd., Kaohsiung City, Taiwan, Prov. of China

[21] Appl. No.: 182,737

[22] Filed: Jan. 14, 1994

[51] Int. Cl.[6] ..... A41D 13/00

[52] U.S. Cl. ..... 2/2; 2/45

[58] Field of Search ..... 2/2, 2.5, 44, 45, 267, 2/268

[56] References Cited

U.S. PATENT DOCUMENTS 4,554,681 11/1985 Kirkland .
4,698,846 10/1987 Wang .
5,159,715 11/1992 Jurga et al. ..... 2/45 X
5,187,812 2/1993 Neuhalfen ..... 2/45 X

*Primary Examiner*—Clifford D. Crowder
*Assistant Examiner*—Paul C. Lewis
*Attorney, Agent, or Firm*—Kirkpatrick & Lockhart

[57] ABSTRACT

A football shoulder pad includes left and right body arches and left and right arch pads. An outer face of each of the left and right arch pads includes a first hook fastener securely attached to each of anterior and posterior portions thereof. An inner face of each of the left and right body arches includes a strip securely riveted to each of anterior and posterior portions thereof, each strip having a first loop fastener securely mounted to one face thereof which faces the outer face of the left and right arch pads for releasably engaging with the first hook fastener.. The connecting shoulder portion of each of the left and right arch pads includes a strap with one end thereof securely attached to a mediate section thereof, the strap extending in a direction perpendicular to a lengthwise direction of the connecting shoulder portion and having a second hook fastener provided to one face thereof. An inner strap, which is riveted to the inner face of each of the left and right body arches at two ends thereof, has a second loop fastener securely attached to one face thereof which faces the inner face of an associated body arch for releasably engaging with the second hook fastener.

1 Claim, 2 Drawing Sheets

REPLACEABLE SHOULDER PADDING FOR FOOTBALL PLAYERS

BACKGROUND OF THE INVENTION

1. Field of the Invention

The present invention relates to an improved replaceable shoulder padding for football players.

2. Description of Related Art

U.S. Pat. No. 4,554,681 to Kirkland discloses a replaceable shoulder padding for football which can be immediately removed and reapplied and which is conducive to durability and to sanitary conditioning. In the athletic gear provided by Kirkland, the straps 26 on the anterior and posterior portions 21 and 22 of the pads P1 have to be troublesomely passed through associated openings 35 in the anterior and posterior portions 31 and 32 of the body arch A for subsequently overlapping one of them over the other. A further drawback of the Kirkland's design is that the straps 26 tend to be ripped by the bitts 36 and 37 on the edged corners of the openings 35 due to abrasion, especially when in intense motions. Another drawback of the straps arrangement is that they are vulnerable to disengage from each other when the athlete intentionally or unintentionally falls and slides on the field surface which might brush and inadvertently untie the straps 26. The strap 25 provided on the connecting shoulder portion 23 of the pad P1 directly engages with the loop element on the connecting shoulder portion 33 of the body arch A by means of the hook element 40 thereon. However, when the athlete is subjected to lateral shoulder-to-shoulder impact loads, the strap 25 tends to disengage from the connecting shoulder portion 33 of the body arch A, the neck of the athlete thus risks being injured by the rigid body arch A even though a roll neck is provided. U.S. Pat. No. 4,698,846 discloses a similar arrangement in the connecting shoulder portions of the body arch and the protective pad and thus has the same drawback, while the engagements and disengagements between the anterior and posterior portions of the body arch and the protective pad are time-consuming.

Therefore, there has been a long and unfulfilled need for an improved replaceable shoulder padding for football players to mitigate and/or obviate the above-mentioned drawbacks.

SUMMARY OF THE INVENTION

A shoulder pad generally includes left and right body arches, left and right shoulder caps, left and right epaulets, and left and right arch pads, an inner strap being riveted to an inner face of each of left and right body arches at two ends thereof.

The present invention is characterized in that: (1) each of the left and right arch pads includes a first hook fastener securely provided to each of anterior and posterior portions on one face thereof which faces an inner face of an associated body arch, and each of the left and right body arches includes a strip securely attached to each of anterior and posterior portions of the inner face thereof, each strip having a first loop fastener securely mounted to an inner face thereof for releasably engaging with the first hook fastener; and (2) each of the left and right arch pads includes a strap with one end thereof securely attached to a mediate section of a connecting shoulder portion thereof, the strap extending in a direction perpendicular to a lengthwise direction of the connecting shoulder portion and having a second hook fastener provided to one face thereof, and a second loop fastener is securely provided to a mediate section of one face of each inner strap which faces the shoulder connecting portion of an associated body arch for releasably engaging with the second hook fastener.

In assembly, the arch pads can be quickly, releasably yet securely attached to the inner faces of the body arches by engaging the first hook fasteners on the anterior and posterior portions of the outer face of respective arch pad with the first loop fasteners on the strips which are disposed on the anterior and posterior portions of the inner face of respective body arch and by engaging the second hook fastener on each strap extending from the shoulder connecting portion of respective arch pad with the second loop fastener on the mediate section of the associated inner strap. By such an arrangement, the disadvantages encountered in prior art are avoided without affecting the ease of removability of the arch pads.

Other objects, advantages, and novel features of the invention will become more apparent from the following detailed description when taken in conjunction with the accompanying drawings.

DESCRIPTION OF THE PREFERRED EMBODIMENT

Figure 1:
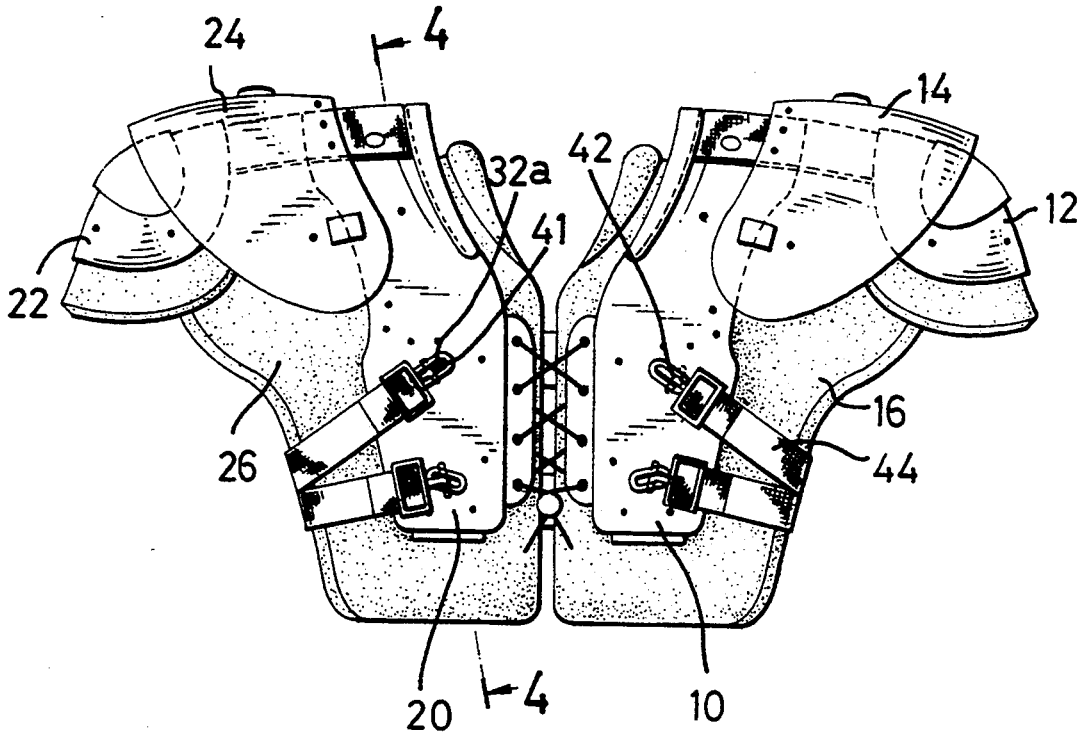
FIG. 1 is a front elevational view illustrating a shoulder pad for football players with a replaceable shoulder padding in accordance with the present invention.
Figure 2:
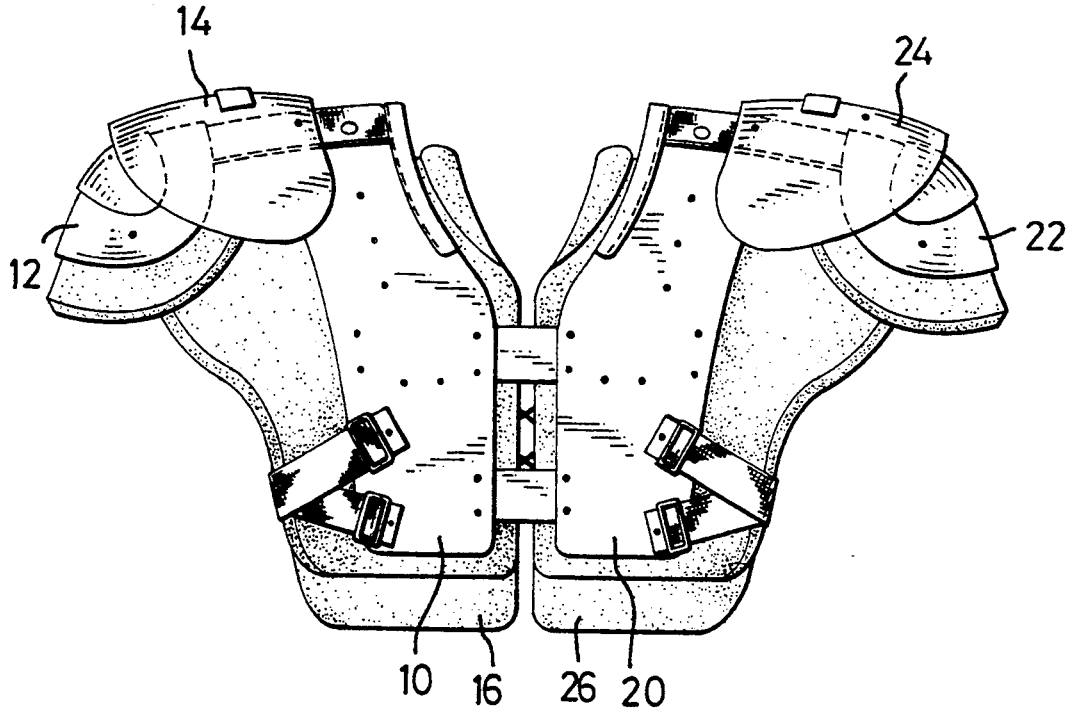
FIG. 2 is a rear elevational view of the shoulder pad in FIG. 1.
Figure 3:
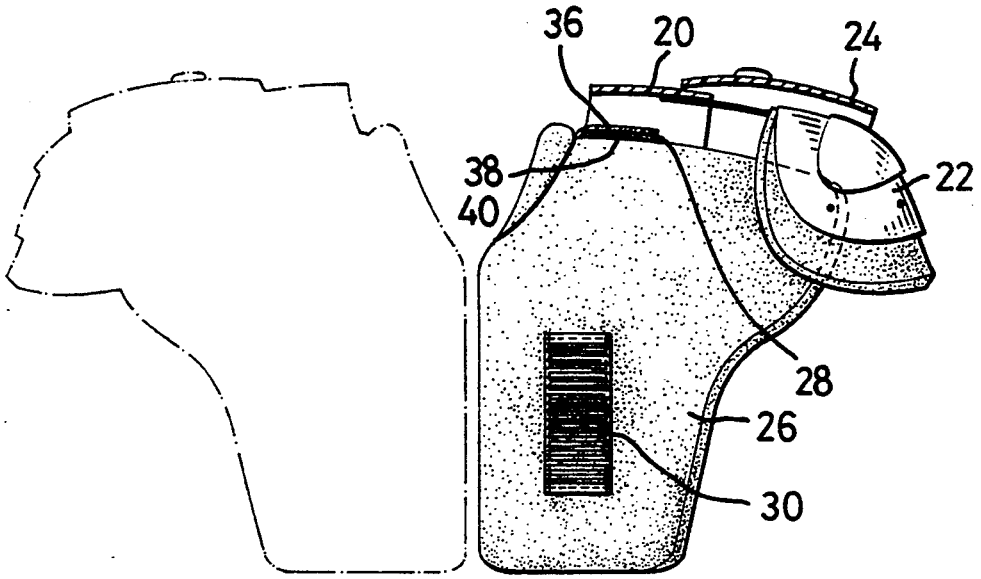
FIG. 3 is a partial cross-sectional view of the shoulder pad.
Figure 4:
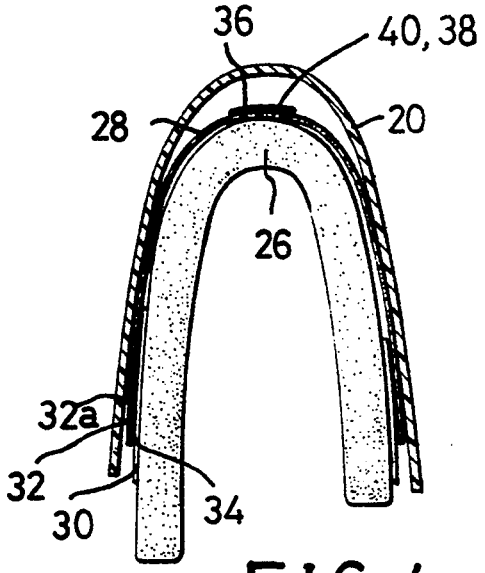
FIG. 4 is a cross-sectional view taken along line 4—4 in FIG. 1.

Referring to FIGS. 1 and 2 of the drawings, a shoulder pad generally includes left and right body arches 20 and 10, left and right shoulder caps 22 and 12, left and right epaulets 24 and 14, and left and right arch pads 26 and 16, an inner strap 28 (see FIGS. 3 and 4) being riveted to an inner face of each of left and right body arches 20 and 10 at two ends thereof. The above-mentioned parts are of a conventional design and will not be further described with respect to their construction.

Figure 5:
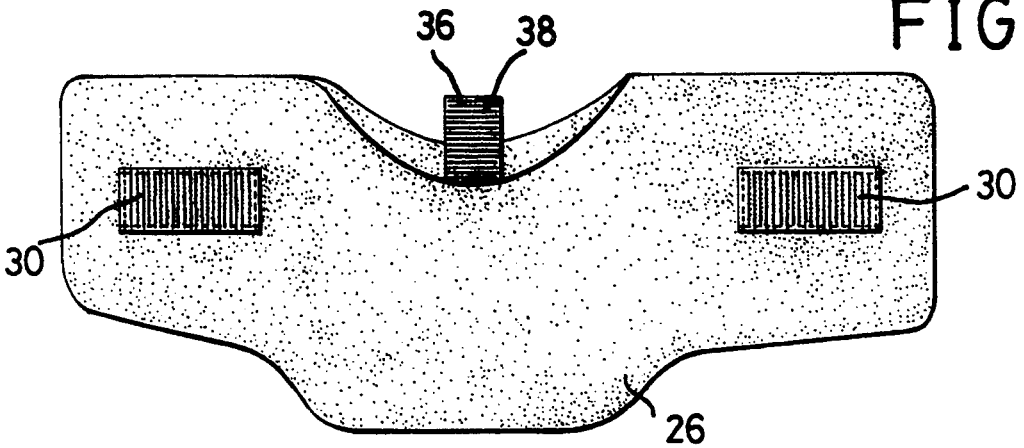
FIG. 5 is a flattened plan view of the left arch pad of the shoulder padding in FIG. 1.

The present invention is characterized in that: (1) each of the left and right arch pads 26 and 16 includes a first hook fastener 30 (see FIGS. 3 through 5) securely provided to each of anterior and posterior portions of an outer face thereof which faces an inner face of the associated body arch 10, 20, and each of the left and right body arches 20 and 10 includes a strip 32 (see FIG. 4) securely riveted to each of anterior and posterior portions of the inner face thereof, each strip 32 having a first loop fastener 34 securely mounted to an inner face thereof for releasably engaging with the first hook fastener 30; and (2) each of the left and right arch pads 26 and 16 includes a strap 36 with one end thereof securely attached (such as by sewing) to a mediate section of a connecting shoulder portion thereof, the strap 36 extending in a direction perpendicular to a lengthwise direction of the connecting shoulder portion and having a second hook fastener 38 provided to one face thereof, and a second loop fastener 40 is securely provided to a mediate section of an inner face of each inner strap 28 which faces the shoulder connecting portion of the body arch 10, 20 for releasably engaging with the second hook fastener 38.

In assembly, the arch pads 16 and 26 can be quickly, releasably yet securely attached to the inner faces of the body arches 10 and 20 by engaging the first hook fasteners 30 on the anterior and posterior portions of the outer face of respective arch pads 16, 26 with the first loop fasteners 34 on the strips 32 which are disposed on the anterior and posterior portions of the inner face of the body arch 10, 20, and by engaging the second hook fastener 38 on each strap 36 extending from the shoulder connecting portion of respective arch pads 16, 26 with the second loop fastener 40 on the mediate section of the associated inner strap 28, wherein each strap 36 is turned over to pass through a space between respective inner strap 28 and the associated body arch 16, 26 and thereafter engages with the respective inner strap 28 by means of hook and loop fasteners 38 and 40 thereon. By such an arrangement, the disadvantages encountered in prior art are avoided without affecting the ease of removability of the arch pads 16, 26.

The other face 32*a* of each of the strips 32 which are mounted to the inner faces of the anterior portions of the left and right body arches 20 and 10 faces the inner face of the body arches 10, 20 and is rigid and shields buckle holes 41 in the anterior portions of the body arches 10, 20 so as to prevent buckle heads 42 of webbings 44 of the shoulder pad from damaging the right and left arch pads 26 and 16.

It is appreciated that the first hook and loop fasteners 30 and 34 respectively provided on the anterior and posterior portions of the left and right arch pads 26 and 16 and left and right body arches 20 and 10 have lengths which allows the wearers to adjust relative engaging positions therebetween, thereby providing suitable protection effects desired by the wearers which have different duties in the football game. Such advantage of allowing adjustment of relative positions between the arch pads 26, 16 and the body arches 20, 10 cannot be achieved by Kirkland's design disclosed in U.S. Pat. No. 4,554,681.

Although the invention has been explained in relation to its preferred embodiment, it is to be understood that many other possible modifications and variations can be made without departing from the spirit and scope of the invention as hereinafter claimed.

I claim:

1. A shoulder pad comprising left and right body arches each having an inner face with an anterior portion, a posterior portion, and a connecting shoulder portion, and left and right arch pads each having an outer face with an anterior portion, a posterior portion, and a connecting shoulder portion, an inner strap being securely attached to said inner face of each of said left and right body arches at two ends thereof, the improvement comprising:

said outer face of each of said left and right arch pads including a first hook fastener securely attached to each of said anterior and posterior portions thereof;

said inner face of each of said left and right body arches including a strip securely attached to each of said anterior and posterior portions thereof, each said strip having a first loop fastener securely mounted to one face thereof which faces said outer face of said left and right arch pads for releasably engaging with said first hook fastener;

said connecting shoulder portion of each of said left and right arch pads including a strap with one end thereof securely attached to a mediate section thereof, said strap extending in a direction perpendicular to a lengthwise direction of said connecting shoulder portion and having a second hook fastener provided to one face thereof; and each said inner strap having a second loop fastener securely attached to one face thereof which faces said inner face of associated said body arch for releasably engaging with said second hook fastener.

* * * * *